US005207759A

United States Patent [19]

Mehmandoust et al.

[11] Patent Number: 5,207,759

[45] Date of Patent: May 4, 1993

[54] TEXTURING SLURRY AND METHOD

[75] Inventors: Yassin Mehmandoust, Berkeley; Atef H. Eltoukhy, Saratoga; Abdoul H. Riahi-Samani, San Jose, all of Calif.

[73] Assignee: HMT Technology Corporation, Fremont, Calif.

[21] Appl. No.: 763,228

[22] Filed: Sep. 20, 1991

[51] Int. Cl.[5] ..... B24B 1/00

[52] U.S. Cl. ..... 51/281 SF; 51/317; 51/129; 51/132

[58] Field of Search ..... 51/281 R, 281 SF, 317, 51/129, 131.1, 131.3, 131.4, 132

[56] References Cited

U.S. PATENT DOCUMENTS 4,179,852 12/1979 Barnett ..... 51/281 SF
4,475,981 10/1984 Rea ..... 51/317
4,586,296 5/1986 Saunders ..... 51/132
4,883,502 11/1989 Miyazaki et al. ..... 51/309
4,915,710 4/1990 Miyazaki et al. ..... 51/309
4,929,257 5/1990 Miyazaki et al. ..... 51/309

FOREIGN PATENT DOCUMENTS 0042283 12/1979 Japan .
0205974 8/1989 Japan .

*Primary Examiner*—Bruce M. Kisliuk
*Assistant Examiner*—Bryan Reichenbach
*Attorney, Agent, or Firm*—Peter J. Dehlinger

[57] ABSTRACT

A method for texturing a disc substrate, and a particle slurry for use in the method. The slurry includes two populations of different-size particles, preferably one population containing particles in a 3 micron size range, and a second population containing particles in a 1 micron size range. The particles, when used to abrade the surface of a disc, create a surface texture characterized by a low peak/peak-to-valley ratio.

3 Claims, 4 Drawing Sheets

TEXTURING SLURRY AND METHOD

FIELD OF THE INVENTION

The present invention relates to a method of texturing the surface of a disc substrate, and to a slurry for use in such a method.

BACKGROUND OF THE INVENTION

Over the past several years, a significant increase in recording density in thin-film magnetic recording discs has been achieved, and there is a continuing effort to increase recording density further.

A number of magnetic properties in a thin-film disc are important to achieving high recording density, including high coercivity and remanance, and low flying height. The latter property is important because, as the read/write head is moved closer to the disk, there is less overlap of voltage signals in adjacent magnetic domains in the disc, with a corresponding increase in recording density.

Heretofore, disks having high coercivity and remanance characteristics have been prepared by sputtering a thin magnetic film on a metal substrate, typically an aluminum substrate. Prior to sputtering, the substrate is plated with an alloy plating, such as a nickel/phosphorus plating to achieve a requisite surface hardness. The plated disc is then polished to remove surface nodules which form during the plating process.

The plated substrate may be textured by abrading or sanding, using a rotary abrasive pad placed off center with respect to the surface of the spinning substrate, or by etching with acid. The purpose of the texturing is to create a roughened surface characterized by submicron surface irregularities. The roughened surface reduces stiction (static friction) between the disk and head by reducing surface contact between the two, particularly for start/stop cycles.

The sputtering operation used to produce the thin magnetic film is preferably carried out by first sputtering a chromium underlayer onto the substrate surface, then sputtering a cobalt-based magnetic thin film over the underlayer. A protective, lubricating carbon overcoat is applied over the thin-film layer by sputtering.

Despite the favorable magnetic and surface-wear properties which can be achieved in the above-described thin-film magnetic disc formed on a metal substrate, the recording density of the disc is limited in flying height by the irregularities on the disk surface (due to the surface texturing and surface irregularities related to the plating operation). In addition, surface peaks can appreciably increase the wear on the disc, and on the read-write head.

SUMMARY OF THE INVENTION

It is one general object of the invention to provide a method for mechanically texturing a disc substrate to achieve surface texture properties which are compatible with reduced wear, lower flying height, and low stiction.

Another object of the invention is provide a particle slurry for use in such method.

The invention includes, in one aspect, a method of texturing a magnetic disc substrate by applying to at least a portion of the substrate surface, a slurry containing first texturing particles whose sizes are distributed about one particle size within one particle size range and second particles whose sizes are distributed about a second, smaller size within a second size range. A texturing pad is pressed against the substrate in the presence of the slurry, and the pad is moved relative to substrate until the desired surface texture features are achieved.

In one preferred embodiment, the total weight of the texturing particles of the particle slurry comprises between about 20–40 weight percent of particles in an approximately 3 micron size range, and between about 60–80 weight percent of particles in an approximately 1 micron size range.

Also in a preferred embodiment, the texturing is performed under conditions in which the disc is rotated at a speed between 50 and 250 rpm, the pad is rotated at a speed of between about 8–80 rpm, and the pad is pressed against the disc, with a force of between about 2 and 20 lbs.

In another aspect, the invention includes a slurry for use in mechanically texturing a disc substrate. The slurry is composed of first particles whose sizes are distributed about one particle size within one particle size range, second particles whose sizes are distributed about a second, smaller size within a second size range, a first set of texturing particles of a first size, and a slurry solution in which the first and second particles are suspended.

In a preferred embodiment, the total weight of the texturing particles of the particle slurry comprises between about 10–40 weight percent of the larger particles, e.g., in an approximately 3-micron size range, and between about 60–90 weight percent of smaller particles in an approximately 1 micron size range.

These and other objects and features of the invention will become more fully apparent when the following detailed description is read in conjunction with the accompanying drawings.

DETAILED DESCRIPTION OF THE INVENTION

A. Substrate Texturing

Figure 1:
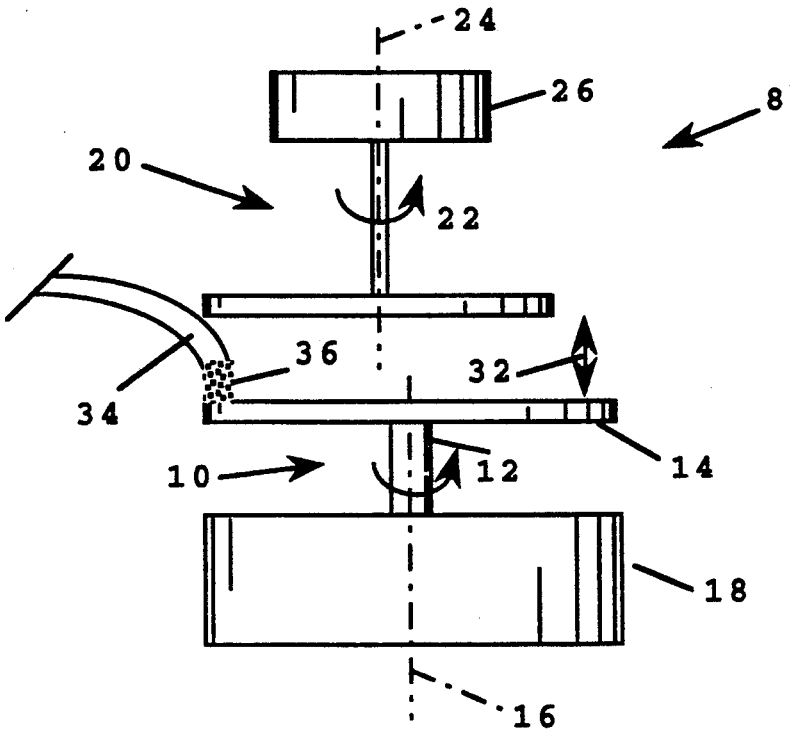
FIG. 1 shows an apparatus incorporating the texturing slurry of the present invention, for use in texturing an aluminum substrate.

FIG. 1 is a schematic view of an apparatus 8 designed for use in texturing the surface of a substrate, in accordance with the invention. A substrate assembly 10 in the apparatus includes a spindle 12 which rotates a substrate, such as substrate 14, about the disc's central axis, indicated by dashed line 16. The spindle is driven by a motor 18 whose speed can be adjusted within the range of 50–400 rpm.

A pad assembly 20 in the apparatus includes a spindle 22 which is rotatable about an axis 24 that is parallel to and offset from axis 16. The relative offset of the two rotational axes can be adjusted. The spindle is driven, at a selected speed typically between about 8–80 rpm, by a motor 26 in the pad assembly. The texturing pad of the invention, indicated here at 30 is mounted on the spindle for rotation therewith.

The pad assembly is mounted for shifting toward and away from a texturing position at which the surface of the pad is brought into contact with the surface of the substrate, with a selected contact force. The shifting mechanism in the apparatus is indicated by arrow 32, and is also referred to as shifting means. The mechanism can be controlled to apply a desired force, typically about 2–20 lbs, between the pad and substrate surface.

Completing the description of what is shown in the figure, the apparatus includes a tube 34 for introducing a particle slurry 36 onto the surface of the disc (or pad), as the pad is brought into contact with the substrate. The tube is also referred to herein as means for introducing the slurry between the pad and substrate. Typically, the slurry is dripped or sprayed onto the substrate. The basic texturing apparatus or machine just described is commercially available, such as from Strausbough, (San Jose, Calif.).

Pad 40 has a typical diameter between about 3–5 inches, preferably about 3.5 inches. The pad is formed of a relatively incompressible material, such as polyurethane impregnated with polyester-based material, which is effective to produce relatively deep texturing grooves in the contacted region of the substrate, when the substrate and pad are brought into contact in the above apparatus in the presence of a particle slurry. Preferred pads have a compressibility of between 15–17%, and a hardness of about 50–70 durometers. One suitable material is the surface material of a Suba-4 TM texturing pad, available from Rodel (Scottsdale, Ariz.).

To produce a textured substrate, in accordance with the invention, a substrate is mounted on spindle 12 in the texturing apparatus. The substrate is preferably an aluminum substrate, with standard dimension inner and outer diameters. Two conventional size substrates have outer diameters of 130 or 95 mm, with corresponding inner diameters of 40 and 25 mm, respectively. The substrate is preferably first plated with a selected alloy plating, such as a nickel/phosphorus plating, to achieve a requisite surface hardness. The thickness of the plating is typically about 400–700 Å. The textured, plated substrate is then polished to remove surface nodules which form during the plating process, according to standard procedures.

With the above-described pad mounted on spindle 22 in the apparatus, the speed of the substrate and pad are preferably set at about 125 rpm and about 10 rpm, respectively.

As the pad is moved into a position of contact with the substrate, a particle slurry according to the invention is introduced onto the substrate or pad. According to an important feature of the invention, the slurry is composed of first particles whose sizes are distributed about one particle size within one particle size range, second particles whose sizes are distributed about a second, smaller size within a second size range, and a slurry solution in which the first and second particles are suspended.

In a preferred embodiment, the total weight of the texturing particles of the particle slurry comprises between about 10–40 weight percent of particles in an approximately 2.5–3.5 micron size range, and between about 60–90 weight percent of smaller particles in an approximately 0.5–1.5 micron size range. One preferred type of first particles are $Al_2O_3$ particles having a mean particle size of 3 microns and a particle distribution between about 0.5 and 6 microns; one preferred type of second particles are $Al_2O_3$ particles having a mean particle size of 1 microns and a particle distribution between about 0.52 and 2 microns The particles are suspended, at a selected weight ratio, in a glycol or other appropriate slurry. Such slurries and particles are supplied by Coral Chemicals (Paramount, Calif.). The weight ratios of the two particles are selected, in accordance with the invention to achieve desired surface texture features, particularly a desired peak/peak-to-valley ratio, as will be seen in Section C below.

During the texturing process, the texturing pad is brought into the contact position, and a constant contacting force of between 2–20 lbs, and preferably about 15 lbs, is maintained for a period of between 15 and 75 seconds. Throughout the period in which the disc and texturing pad are in contact, the pad and substrate rotation speeds are maintained at a texturing pad:disc speed ratio of between 2:5 and 1:30.

Figure 2:
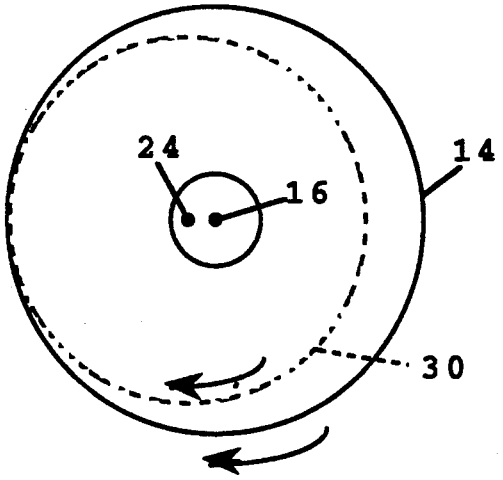
FIG. 2 shows the planar arrangement of a substrate (solid lines) and pad (dotted lines) in a texturing method.

FIG. 2 shows in plan view, the relative planar arrangement of the pad (dotted lines) and substrate (solid lines) during a texturing operation. The common direction of rotation in a clockwise direction in the figure is indicated by arrows.

B. Thin-Film Textured Disc

Figure 3:
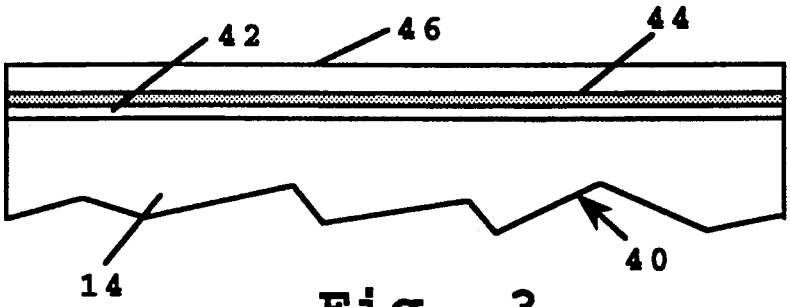
FIG. 3 shows an enlarged, fragmentary sectional view of a magnetic recording disc formed in accordance with the invention.

FIG. 3 shows an enlarged, fragmentary, cross-sectional view of a thin-film magnetic disc 40 formed on the above substrate, in accordance with the invention.

The three layers formed on the substrate include a chromium underlayer 42, a thin-film magnetic layer 44, and a carbon overcoat 46. These layers are preferably formed by sputtering, according to known methods (e.g., U.S. Pat. No. 4,816,127). Briefly, the substrate is placed in a conventional sputtering apparatus and moved through a succession of sputtering chambers designed for sputtering onto the substrate (a) a chromium underlayer, to a thickness of about 1,000 to 4,000 Å, (b) a thin-film magnetic layer, to a thickness of about 300–1,500 Å, and a carbon overcoat. The thin-film layer is preferably a cobalt-based alloy containing, in one embodiment, 1–10% tantalum, 10–16% chromium, and 60–85% cobalt, and in another embodiment, 2–10% chromium, 20–28% nickel, and 70–88% cobalt.

The carbon overcoat is applied to a final thickness preferably between about 200–500 Å. The sputtered thin-film layers may be coated by a standard fluorocarbon polyether lubricant.

C. Surface Properties of the Textured Disc

The surface features of the textured substrate can be quantified by standard interferometry methods, in which the heights at many positions over the surface of the substrate is measured, and these coordinates are used to construct a three-dimensional topographic map of the surface. The interferometry measurements and calculations can be performed by commercially available interferometers, equipped with known microcomputer capability for calculating standardized average surface roughness, number of summits and maximum peak to valley distance, in a direction normal to the plane of the disc, over a given area, typically about 50 $\mu^2$. A summit is a peak that is at least a predetermined amount higher than the four nearest peaks. One interferometer which is suitable for this purpose is a Mirau Interferometer, Model Topo 3D, obtained from WYKO (Tucson, Ariz.).

Alternatively, the measurements may be taken with a contact profilometer. The profilometer consists of a stylus tip, typically diamond, which is dimensioned to follow the contour of the surface features of the disc. The stylus is slidably moved along a portion of the disc surface, usually over about a 1,000 $\mu$ interval, and the displacement of the stylus tip is recorded. One such device is available from Dektack.

The surface texture measurements described below were taken on the surface of a thin film medium having a sputtered underlayer, a magnetic thin film, and a carbon overcoat formed on the textured substrate, as described above. The surface texture features accurately reflect the surface features of the textured substrate itself.

Figure 4:
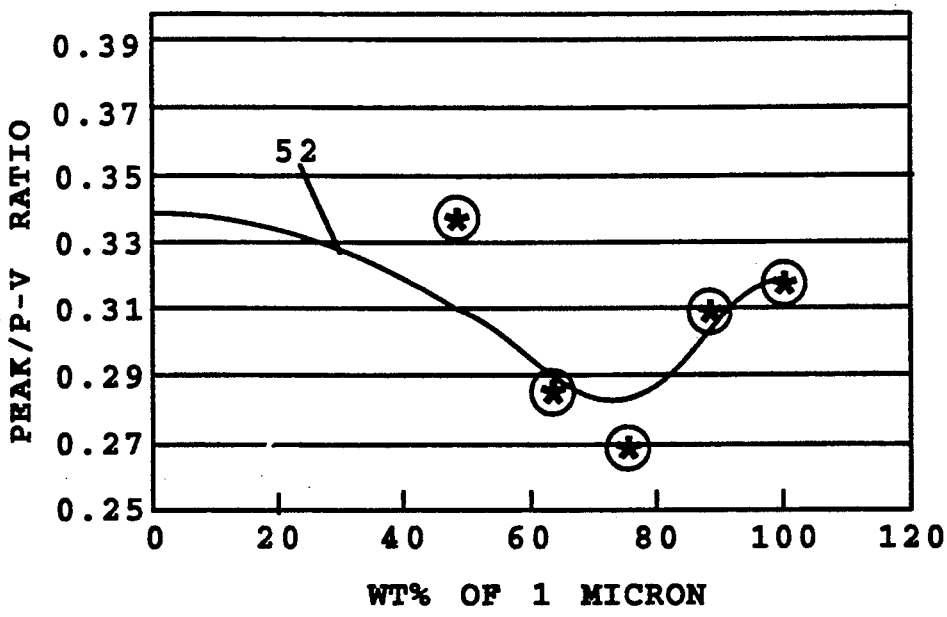
FIG. 4 is a plot showing the peak/peak-to-valley ratios of substrates when textured with a compound slurry according to the invention for different proportions of constituent particles.

FIG. 4 is a plot of peak/peak-to-valley ratio observed when an aluminum nickel/phosphorus-plated substrate is textured with a slurry having various weight ratios of 3 and 1 micron size particles, as indicated in the figure. The peak height is the average maximum peak heights above mean line, and the peak-to-valley value is the average maximum peak-to-valley heights, both determined by standard calculation methods provided in a WYKO Model Topo 3D Interferometer (see below).

As seen from curve 52 in FIG. 4, the peak/peak-to-valley ratio is about 0.34 for 3 micron particles, and this ratio changes very little even when the slurry contains up to 50 percent by weight of small (1 micron) particles. However, at higher weight ratios of the small particles, up to about 75 weight percent of small particles, peak/peak-to-valley ratio drops significantly. Interestingly, the highest ratios of small particles (82 and 100 percent), increase in peak/peak-to-valley ratio occurs.

Qualitatively, the results seen in FIG. 4 can be explained as follows. Initially, both 3-micron and 1-micron particles are acting to scour the substrate surface, forming both relatively deep grooves (the larger particles) and relatively shallow grooves (the smaller particles). In time, as the deeper grooves become established, the smaller particle scouring effect will be confined principally to the peaks, acting at this stage to shave off the tops of the peaks, without significantly affecting the groove pattern or valleys formed in the substrate. The net effect is a selective reduction in maximum peak height, with a corresponding reduction in peak/peak-to valley ratio. The advantages of this feature will be described below.

Figure 5:
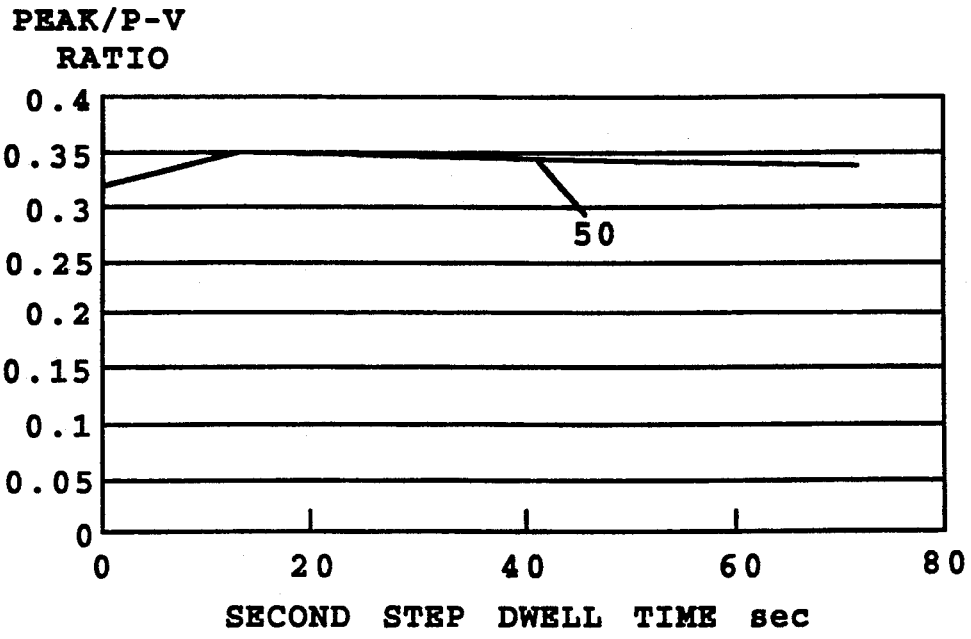
FIG. 5 is a plot showing the peak/peak-to-valley height ratios of substrates when textured first with a slurry having only three-micron particles, followed by a slurry having only one-micron particles.

In view of the texturing events discussed above, it might be asked whether the same surface features would be observed by successively texturing a substrate with larger, e.g., 3-micron, particles, then with smaller, e.g., 1-micron particles, in separate texturing operations. This method was examined, with the results shown in FIG. 5, which shows the ratio of peak height/peak-to-valley height in a substrate first textured with 3-micron particles, then "finished" with a 1-micron texturing step, for various dwell times out to 75 seconds. As seen in the figure, no significant change in peak/peak-to-valley ratio was observed even after 75 seconds of the finishing step. It can therefore be concluded that the combination of larger and smaller particles, acting together in a texturing operation, produces a desired surface result not obtainable by the use of the same particles in separate texturing steps.

Figure 6:
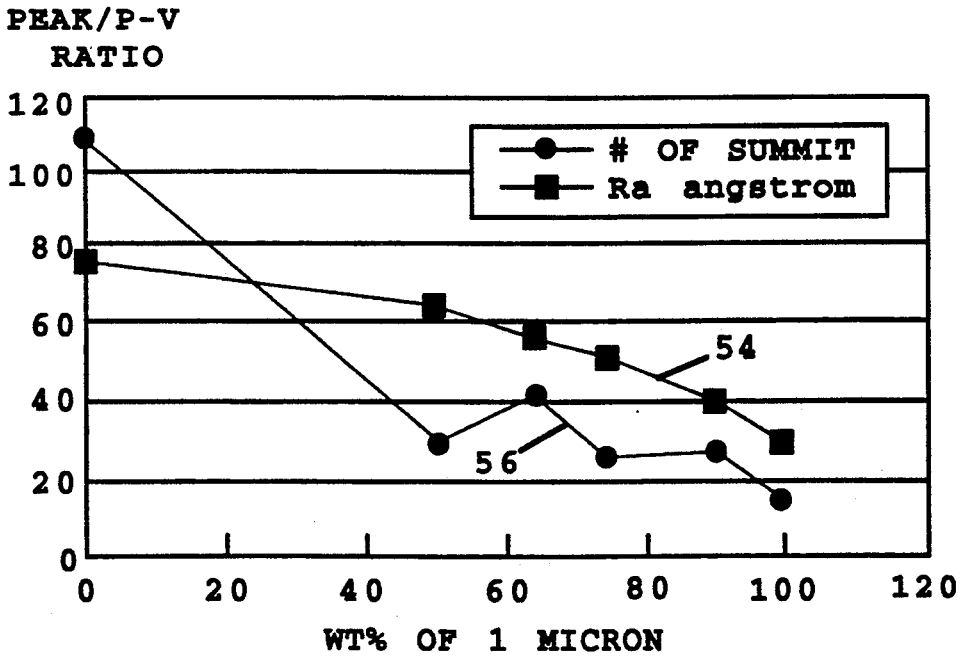
FIG. 6 is a plot showing the effect of particle-size distribution on surface roughness.

FIG. 6 shows how slurry composition, as reported in FIG. 4, affects two other surface parameters: surface roughness (* symbols, curve 54) and number of summits (+ therefore symbols, curve 56). Summit number is determined also by a standard method in which a summit is defined as a point higher than its four adjacent peaks. Not surprisingly, the number of summits is reduced with increasing amounts of small particles, reflecting the gradual shaving down of the peaks in the surface.

Surface roughness is the arithmetic mean roughness value, calculated from the integral of the absolute value of peak or valley with respect to a center line, according to standard methods. The decline in surface roughness seen with increasing weight ratio represents the reduced peak and valley heights observed with a greater contribution of smaller particles.

Figure 7:
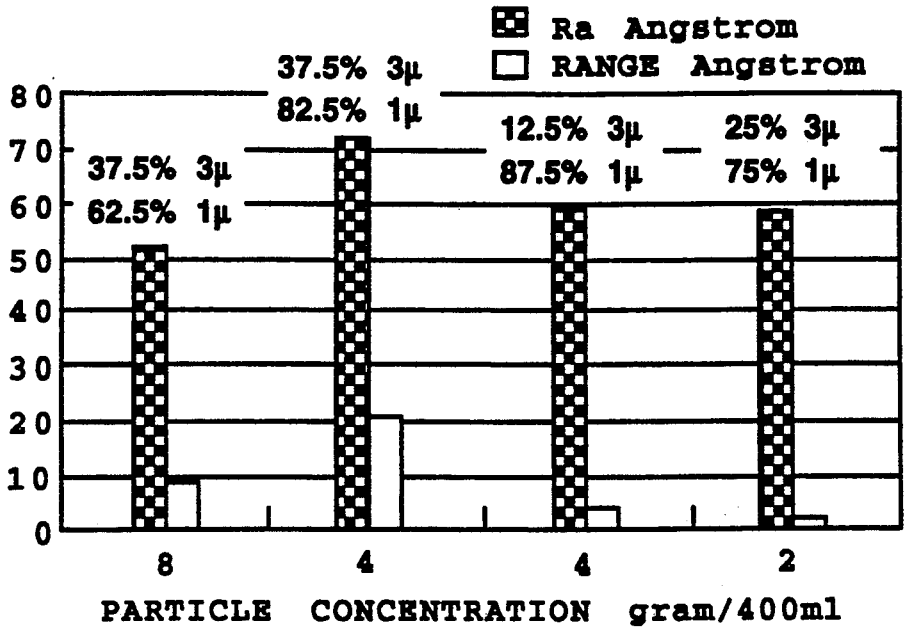
FIG. 7 is a bar chart showing representative surface roughness and range of surface roughness for various particle size distributions and concentrations in the slurry.

Another variable in the method which can be adjusted to achieve selected surface features, in the method of the invention, is total particle concentration measured, for example, in gram/100 ml. FIG. 7 shows how the arithmetic mean roughness value, and range in peak heights, varies with different particle concentrations. At similar particle compositions (37.5% 3-micron and 62.5% 1-micron), increasing particle concentration increased both roughness and peak height range. A comparison of the two methods performed at 4 g/400 ml, it is seen that lower roughness and a narrower peak heights are achieved at a higher concentration of smaller particles. This same effect is seen at a particle concentration of 2 g/400 ml.

Figure 8:
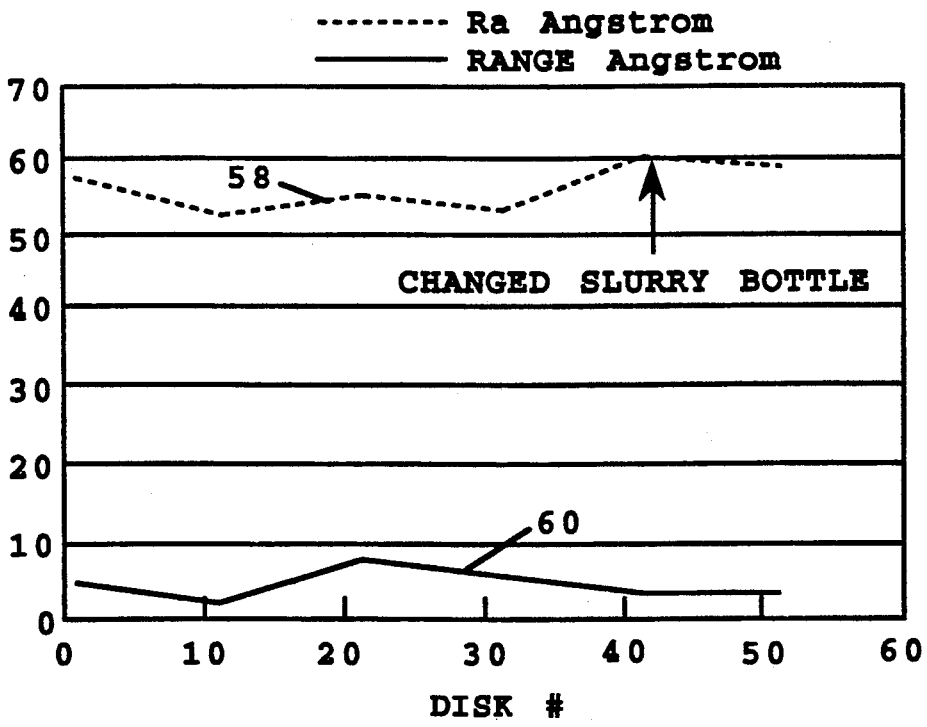
FIG. 8 is a plot showing surface roughness and range of roughness as a function of the number of substrate treatments, using a slurry that is 60% 1-micron particles and 40% 3-micron particles.

FIG. 8 shows the variation in measured surface roughness, as represented by curve 58, and a range of roughness, as represented by curve 60, as a function of substrate treatments, using a 60% composition of 1 $\mu$ particles. There is no significant change in the observed surface texture properties after treating 40 discs with the same slurry.

The advantages achieved in the texturing method of the invention can be seen from the surface texture features achieved in the invention. An ideal surface would have reduced peak height, and more uniform peak heights (reduced summits and lower peak/peak-to-valley ratio), to reduce wear on the disc and on the read/write head, and to allow lower flying height. At the same time, the surface area of contact between the disc and head should be minimized, in order to reduce the stiction coefficient between the head and disc during start-stop operations.

In practice, these two competing demands require a compromise between reduced peak height and greater contact area which occurs as peaks are reduced. In the present invention, this compromise is achieved by selectively shaving peaks, to achieve reduced wear and lower flying height, while leaving peak-to-valley distances relatively unchanged, to produce a minimum reduction in surface roughness and stiction coefficient. In fact, the stiction coefficient for a thin-film medium does increase slightly (from about 0.2 to 0.3) compared with a disc whose substrate is prepared by 3-micron surface texturing alone, but with a significant gain in disc lifetime and flying height.

Another advantage of the invention is reduced imperfections caused by asperities in the textured disc. Typically, after a texturing process, the substrate surface must be burnished to remove the highest peaks and this can result in imperfections in the surface and surface debris. In the present method, the burnishing step is obviated by the "finishing" effect of the smaller particles during a single texturing operation.

Further, the texturing method is readily adaptable to existing texturing machines, and requires no additional steps or processing time over conventional methods. In fact, the method obviates an additional burnishing step, as noted above.

Although the invention has been described with respect to particular embodiments, it will be appreciated that the method and slurry can be modified in a variety of ways consistent with the results and objectives of the invention, and without departing from the invention.

It is claimed:

1. A method of texturing a magnetic disc substrate comprising the steps of:

applying to at least a portion of a surface of the substrate a slurry containing texturing particles, a total weight of said particles comprising between 10–40 weight percent of first texturing particles having sizes between about 2.5–3.5 microns and between 60–90 weight percent of second texturing particles having sizes between about 0.5 to 1.5 microns, pressing a texturing pad against the substrate in the presence of the slurry; and moving the pad relative to the substrate, and thereby scouring the substrate with the first and second particles of the slurry.

2. The method according to claim 1, wherein the slurry has a concentration of particles that is less than 1 g/100 ml.

3. The method of claim 1, wherein said moving includes rotating said disc substrate at a speed between 50 and 250 rpm, and rotating said pad, with the same pressed against said disc substrate, at a speed of between about 8 and 80 rpm.

* * * * *